US009129766B2

(12) United States Patent
Koch

(10) Patent No.: US 9,129,766 B2
(45) Date of Patent: Sep. 8, 2015

(54) SWITCHING DEVICE

(75) Inventor: Michael Koch, Vienna (AT)

(73) Assignee: EATON INDUSTRIES (AUSTRIA) GMBH, Schrems (AT)

( * ) Notice: Subject to any disclaimer, the term of this patent is extended or adjusted under 35 U.S.C. 154(b) by 0 days.

(21) Appl. No.: 14/235,108

(22) PCT Filed: Jul. 26, 2012

(86) PCT No.: PCT/EP2012/064735

§ 371 (c)(1),
(2), (4) Date: Apr. 25, 2014

(87) PCT Pub. No.: WO2013/014251

PCT Pub. Date: Jan. 31, 2013

(65) Prior Publication Data

US 2014/0347778 A1 Nov. 27, 2014

Related U.S. Application Data

(60) Provisional application No. 61/511,718, filed on Jul. 26, 2011.

(30) Foreign Application Priority Data

Jul. 26, 2011 (AT) ..... 1092/2011

(51) Int. Cl.

| | |
|---|---|
| ***H01H 47/00*** | (2006.01) |
| ***H01H 47/02*** | (2006.01) |
| ***H01H 83/04*** | (2006.01) |
| *H01H 83/14* | (2006.01) |
| *H01F 29/14* | (2006.01) |
| *H01H 47/22* | (2006.01) |

(52) U.S. Cl.
CPC ..... *H01H 47/02* (2013.01); *H01H 83/04* (2013.01); *H01F 2029/143* (2013.01); *H01H 47/002* (2013.01); *H01H 47/22* (2013.01); *H01H 83/144* (2013.01)

(58) Field of Classification Search
CPC ..... H01H 83/04; H01H 47/02
USPC ..... 361/143
See application file for complete search history.

(56) References Cited

U.S. PATENT DOCUMENTS 4,002,999 A * 1/1977 Hesler et al. ..... 331/113 A

FOREIGN PATENT DOCUMENTS

| | | | |
|---|---|---|---|
| DE | 4432643 | A1 | 3/1996 |
| GB | 1602843 | A | 11/1981 |
| WO | WO 2009043075 | A2 | 4/2009 |

* cited by examiner

*Primary Examiner* — Thienvu Tran
*Assistant Examiner* — Tien Mai
(74) *Attorney, Agent, or Firm* — Leydig, Voit & Mayer, Ltd.

(57) ABSTRACT

A switching device includes at least a first input and a second input, as well as at least a first output and a second output. The first input is connected with the first output through a first controller and a first switch contact pair. The second input is connected with the second output through a second controller and a second switch contact pair. The switching device further includes a transformer with a core. The first controller forms at least a first coil of the transformer and the second controller forms at least a second coil of the transformer. A switch arrangement is configured to maintain an unsaturated state of the core.

14 Claims, 2 Drawing Sheets

SWITCHING DEVICE

CROSS-REFERENCE TO PRIOR APPLICATIONS

This application is a U.S. National Phase Application under 35 U.S.C. §371 of International Application No. PCT/EP2012/064735, filed on Jul. 26, 2012, and claims benefit to Austrian Patent Application AT A1092/2011, filed on Jul. 26, 2011 and to U.S. Provisional Patent Application No. 61/511,718. The International Application was published in German on Jan. 31, 2013 as WO 2013/014251 under PCT Article 21(2).

FIELD

The invention relates to a switching device and method for maintaining an unsaturated core of a transformer.

BACKGROUND

Residual current protection devices are known, which monitor electrical lines that lead to a partial power supply system or load, and by the occurrence of a residual current, therefore a difference between the fed and derived current, disrupt the power supply of the partial power supply system. Normally, the electrical lines that lead to the partial power supply or load are monitored through a summation current transformer. Upon occurrence of a residual current, a trigger circuit connected with the summation current transformation is activated, which in turn separates switch contacts, through which the partial power supply or the load is separated from the supply network.

Such residual current protection switches have a setup to examine the functionality. Thus, a test line with a test button is designated, whereby the test line leads past parts of the current on the summation current transformer once the test button is activated. Upon activating the test button, a triggering of the residual current protection switch occurs, whereby the lead is separated from the supply network through this inspection. That is why this inspection is often not executed, because for example loads like computers or servers react sensitively to disruptions in the power supply, or due to the inconvenience of having to reset the clocks from different electronic devices, like video recorders, after a power interruption.

In order to hinder a disruption of the power supply to the load during the inspection, a switching device can be used to bridge over for the duration of the inspection of the residual current protection switch. Now the problem exists that by the bridging over of the residual current protection switch under real conditions there will by asymmetry in regards to the part of the current, which is guided through the switching device on the residual current protection switch before the bridge-over is complete or the residual current protection switch cannot be reset after inspection without triggering it.

In order to compensate for this asymmetry, the lines from the switching device can be coupled with each other for bridging through a transformer. Through this, there should be a symmetry of the two currents, which should be used to compensate for the asymmetry of the bridge over switch.

This theoretical function or effect, however, does not exist in the reality of an electrical installation environment. In real systems, actual asymmetry occurs that is so big that its compensation, in accordance with the state of technology, is only possible with very large magnetic cores. Nevertheless, this is disadvantageous in practice, because such magnetic cores have very large dimensions and mass, which makes their integration in a conventional installation difficult. Such cores consist of high quality materials and illustrate a significant cost factor from a corresponding switching device. Both the dimensions as well as the high costs of such practical switching devices decrease the processing, whereby often the installation of such switching devices is waived at a whole. This leads to the functionality of the residual current protection switches, which should protect load circles with an undesired switch off, not being inspected for a longer period of time and through this, a possibly defect residual current switch is also not recognized.

Through this, the security in electrical installation arrangements decreases, which exposes people to bodily harm and the systems to a constantly increasing hazard.

SUMMARY

In an embodiment, the present invention provides a switching device including at least a first input and a second input, as well as at least a first output and a second output. The first input is connected with the first output through a first controller and a first switch contact pair. The second input is connected with the second output through a second controller and a second switch contact pair. The switching device further includes a transformer with a core. The first controller forms at least a first coil of the transformer and the second controller forms at least a second coil of the transformer. A switch arrangement is configured to maintain an unsaturated state of the core.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

In an embodiment, the present invention specifies the previously named switching devices, which can be used to avoid the mentioned disadvantages, with which a disruption-free inspection of a residual current protection switch is possible under real conditions, which has a low dimension and mass and with which the protection against residual currents in electrical systems can be increased. Through this, there is the advantage that the functionality of a residual current protection switch can occur reliably without disruption of the circuit under real conditions. This is particularly important for sensitive loads for example like servers and/or loads that should be permanently in operation, for example, life-sustaining machines in an intensive care station. Through this, the functionality of the residual current protection switch by such important and/or sensitive loads can be inspected regularly and without great effort. The switching device can be connected to existing residual current protection switches without modifications to the residual current protection switch being necessary, because the switching device has a small size. Furthermore, through the fact that the core of the transformer may have a compact design, through which the switching device requires a lower amount of space and also has a low weight, the switching device can be used easily in existing installation arrangements. The security of the electrical systems can be increased altogether through this.

Furthermore, the invention relates to a method, wherein the task corresponds with the task mentioned above. The advantages of the procedure also correspond with the advantages of the equipment mentioned above.

Figure 1:
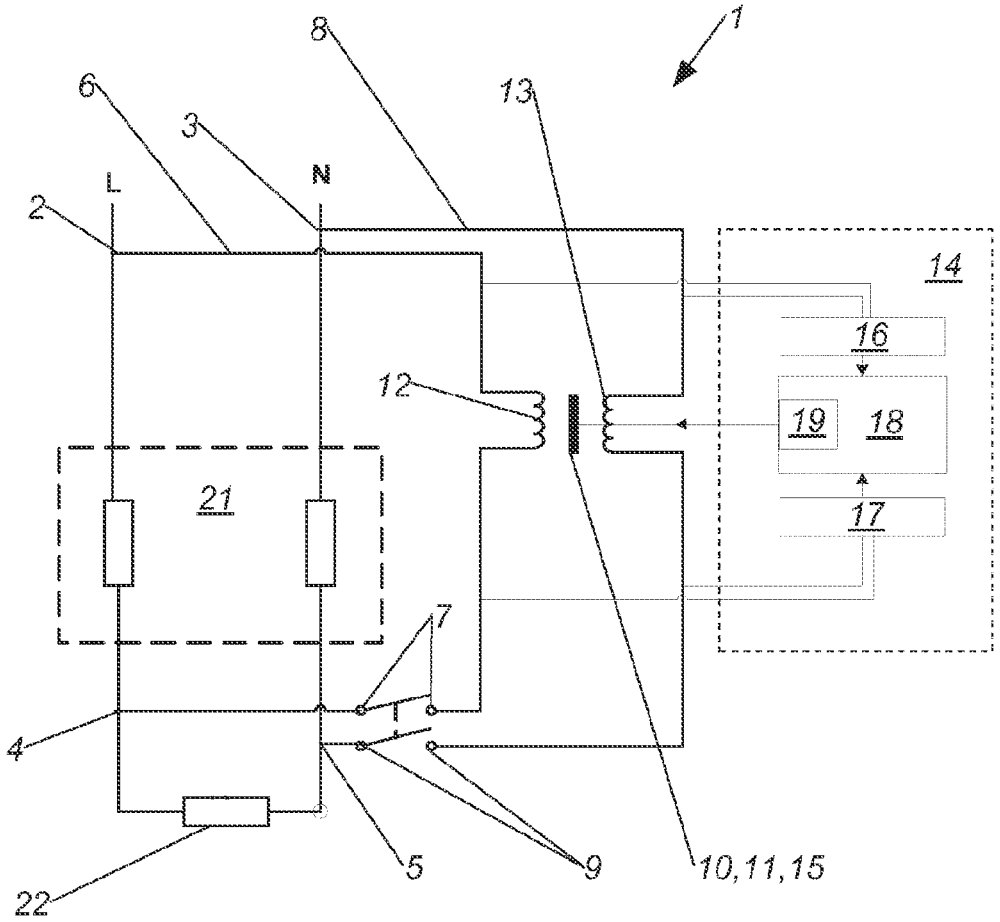
FIG. 1 shows a preferred design of the switching device, which is arranged on a partial circuit with a residual current protection switch as a block circuit diagram.
Figure 2:
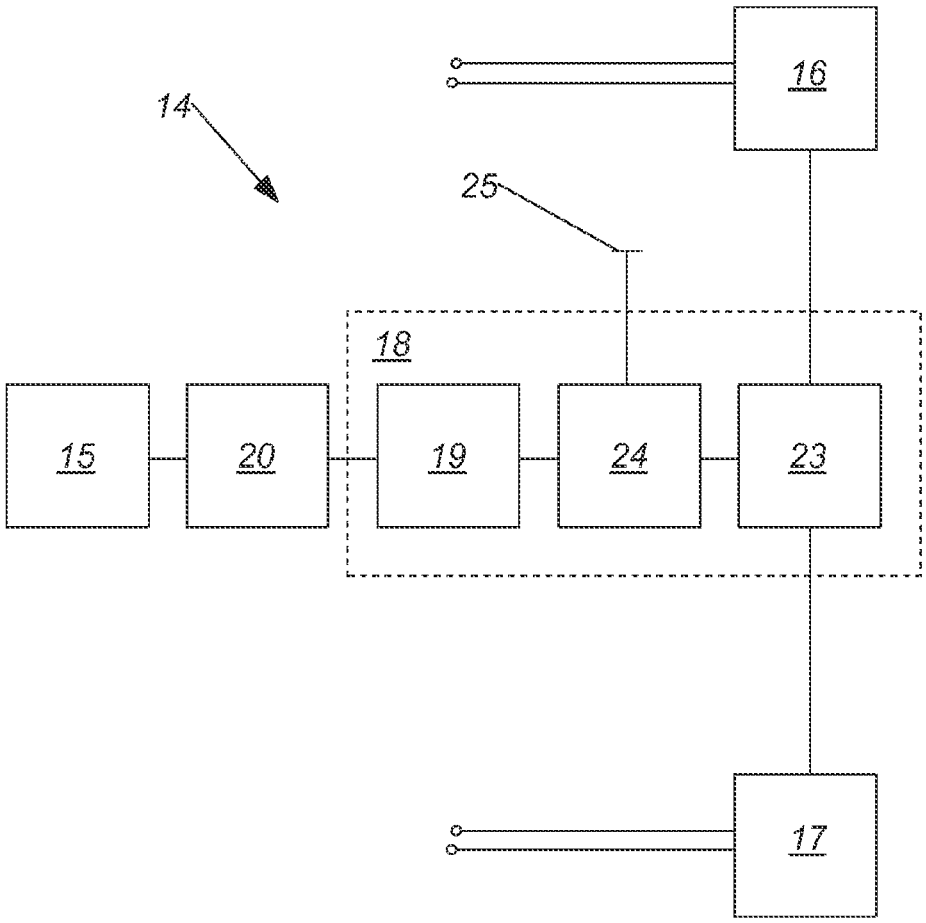
FIG. 2 shows a preferred design of the circuit arrangement as a block circuit diagram.

FIGS. 1 and 2 show a preferred design of a switching device 1 with at least a first input 2 and a second input 3, and at least a first output 4 and a second output 5, whereby the first input 2 is connected with the first output 4 through a first controller 6 and a first switch contact pair 7 and whereby the second input 3 is connected with the second output 5 through a second controller 8 and a second switch contact pair 9, whereby the switching device 1 has a transformer 10 with a core 11 and the first controller 6 at least forms a first winding 12 of the transformer 10 and the second controller 8 at least forms a second winding 13 of the transformer 10, whereby the switching device 1 has a switch arrangement 14 to maintain an unsaturated state of the core 11.

This results in the advantage that the functionality of a residual current protection switch 1 may occur reliably under real conditions without disrupting the circuit. This is particularly important for sensitive loads 22, for example, servers and/or loads 22, which should be permanently in operation, for example, life-sustaining machines at an intensive care station. Through this, the functionality of the residual current protection by such important and/or sensitive loads 22 can also be regularly inspected without great effort. The switching device 1 can also be connected to existing residual current protection switch 21 without modifications to the residual current protection switch 21 being required, because the switching device 1 has a small size. Furthermore, through this the core 11 of the transformer 10 may have a compact design, through which the switching device 1 has a small amount of space needed as well as a low weight, through which the switching device 1 can be easily integrated in existing installations. Altogether, the security of electrical systems can be increased through this.

FIG. 1 shows a preferred installation arrangement with a partial power supply, which has a phase L, a neutral conductor N and a load 22. The phase L and the neutral conductor N are monitored by a multi-pole residual current protection switch 21, in this design a two-pole residual current protection switch 21.

In order to guarantee disruption-free power supply of the load 22 also during an inspection of the functionality of the residual current protection switch 21, a switching device 1 according to the patent is arranged to bridge over the residual current protection switch 21. The switching device 1 has at least a first input 2, which is designated to be connected with phase L on the side of the residual current protection switch 21 facing the power supply and at least a second input 3, which is designated to be connected with the neutral conductor N on the side of the residual current protection switch 21 facing the power supply.

Furthermore, the switching device 1 has at least a first output 4, which is designated to be connected with the phase L of the residual current protection switch 21 facing the load 22 and at least a second output 5, which is designated to be connected with the neutral conductor N on the side of the residual current protection switch 21 facing the load 22.

If the residual current protection switch 21 monitors more than one phase, other inputs and outputs may be designated correspondingly. For example, with three phases in a conventional three-phase current.

The first input 2 is connected with the first output 4 through a first controller 6 and a first switch contact pair 7 and the second input 3 is connected with the second output through a second controller 8 and a second switch contact pair 9.

In order to bridge over multi-pole residual current protection switch 21, more controllers or switch contacts may be designated correspondingly.

Preferred is that the first switch contact pair 7 and the second switch contact pair 9 are coupled with each other in order to switch the first switch contact pair 7 and the second switch contact pair 9 simultaneously, for example, through a mechanical coupling.

The first switch contact pair 7 and the second switch contact pair 9 can, for example, be formed as mechanical switches or as semiconductor switches.

Since the switch contact pairs 7, 9 may have different contact resistances under real conditions and/or the contact resistances vary during the closing process with different processes, there may be different electrical currents in the first controller 6 and the second controller 8. Through this, under circumstances, there may be a disruption of the power supply from the load 22 and/or the residual current protection switch 21 can no longer be reset after an inspection without triggering it.

In order to adapt the currents in the first controller 6 and in the second controller 8, the switching device 1 also has at least a transformer 10 with a magnetized core 11. The core 11 of the transformer 11 consists preferably of a ferromagnetic, magnetically soft material, for example, iron and/or iron-silicium-alloys and/or electrical sheets.

The first controller 6 at least forms a first winding 12 of the transformer 10 and the second controller 8 at least a second coiling 13 of the transformer 10.

Particularly preferred is that the transformer 10 has a translation ratio of 1:1. This may occur in that the coiling number of the first coil 12 and the second coil 13 is identical. Through this, the same current flows in the first controller 6 and in the second controller 8.

Another preference is that the first coil 12 and second coil 13 are wound opposite each other.

With a multi-pole residual current protection switch, for example, the further phases can be coupled in a corresponding manner with the neutral controller N by having further coils arranged on the core 11.

The current in the coils magnetizes the core 11 of the transformer 10, whereby there may be a high magnetic flow density through the magnetic permeability of the core 11. In an unsaturated state of core 11, there is also a linear relationship between the magnetic field strengths caused by the coils 12, 13 and the magnetic flow density in core 11, whose change in contrast causes a tension in the other coil. The core 11, however, has a saturation magnetization, starting at which a further increase of the current in one of the coils does not significantly lead to a further increase of the magnetization of core 11. Already before reaching the saturation magnetization, the core 11 goes from the linear relationship of the unsaturated state to a non-linear relationship between the magnetic field strength and the magnetic flow density, through which the coupling between the first controller 6 and the second controller 8 is destroyed and thus, a symmetrical effect of transformer 10 is no longer present.

Designated is that the switching device 1 has a switch arrangement 14 for the maintenance of an unsaturated state of core 11. The advantages mentioned in the introduction can be achieved through this.

Under maintenance of an unsaturated state of the core 11 in terms of the patent, it is understood that the magnetization of the core 11 is kept in a range in which the magnetic flow density changes linear with the magnetic field strength.

Preferred is that the switch arrangement 14 is designed for the defined inclusion of defined energy in the core 11. This defined energy can, for example, be included in the form of a magnetic energy, which works against the present magnetization of the core 11. Through this, the magnetization of the core 11 can be decreased.

Alternately or in combination, the defined energy may also be thermal energy, whereby if the core 11 exceeds the Curie temperature, it loses its current magnetization.

It may also be preferred that the switch arrangement 14 has a third coil 15, which is arranged on the core 10. Through this, the magnetization of the core 11 may be influenced without the electrical currents in the first controller 6 and in the second controller 8 being directly influenced by the switch arrangement 14.

Preferably, it may be intended that the third coil 15 is wound in several partial coils, in particular symmetrically, around the core 11. Through this, there may be a particularly equal and symmetrical coupling of the magnetic energy in the core 11.

Furthermore, it may be preferred that the winding number of the third coil 15 is greater than the winding number of the first coil 12 and the second coil 13. Through this, the current in the third coil 15 may be kept low.

It may be preferred that the switch arrangement 14 is designed as a closed loop. Through this, the unsaturated state of the core 11 can be kept stable.

For example, the switch arrangement 14 of the installation arrangement can at least collect a measurable value, process this measured value analogue or digital and set a value in the third coil 15 in order to influence the magnetization of the core 11.

The switch arrangement 14 can be designed as a PI controller. Alternatively, a defined value can be set if the measured value fulfils certain defined conditions.

Electrical voltages, voltage differences or current strengths in the first controller 6 and/or the second controller 8 may be used as measured values. Alternatively, the magnetization of the core 11 can also be determined through the third coil 15.

A voltage or a current strength in the third coil 15 can be set as a control value.

It may be preferred that the switch arrangement 14 has an initial measured value detector 16 to detect a first voltage between the first controller 6 and the second controller 8 on a position before the transformer 10. A position before the transformer 10 in terms of the patent means for the first controller 6 that there is a switch technical position between the first input 2 and the first coil 12, and for the second controller 8 a switch technical position between the second input 3 and the second coil 13. Through this, an initial measuring signal may be determined.

Furthermore, it may be preferred that the switch arrangement 14 has a second measured value detector 17 to detect a second voltage between the first controller 6 and the second controller 8 on a position after the transformer 10. A position after the transformer 10 in terms of the patent means for the first controller 6 a switch technical position between the first output 4 and the first coil 12 and for the second controller 8 a switch technical position between the second output 5 and the second coil 13. Through this, a second measuring signal can be determined.

The distortions are determined from the comparison of the first measured signal and the second measured signal from the two measured signals.

The first measured value detector 16 and/or the second measured value detector 17 may, for example, be designed as analogue-digital-transmitters. Through this, the measured value can be easily provided for digital signal processing. Alternatively, the first measured value detector 16 and/or the second measured value detector 17 may also be formed as a voltmeter.

Particularly preferred may be that the switch arrangement 14 has an analysis arrangement 18, for the analysis of the first and/or second voltage determined through the first measured value detector 16 and/or second measured value detector 17 in regards to the distortions caused by transformer 10. Through this, it can be determined if the core 11 of the transformer 10 leaves the unsaturated state.

The analysis arrangement 18 may be preferred as a digital component, for example, as a micro controller or as a digital signal processor. Through this, a high reliability of a standard component may be reached with simultaneously low production efforts. Furthermore, a micro controller or a digital signal processor offer a lot of possibilities for signal processing and analysis. Furthermore, through this fast data processing can be achieved.

Alternatively, the analysis arrangement 18 can also be designed as an analogue switch.

A preferred design form of the switching device 1 with the analysis arrangement 18 is illustrated in FIG. 2. The lines between the individual blocks or modules do not illustrate individual controllers, but rather the respectively required switch technical connections.

In the preferred design, the voltage between the first controller 6 and the second controller 8 before the transformer 10 is recorded by a first measured value detector 16 and the voltage between the first controller 6 and the second controller 8 after the transformer 10 by a second measured value detector 17, whereby both measured value detectors 16, 17 are designed as analogue-digital-transmitters.

The digital measurements are forwarded to the analysis arrangement 18, which is formed in the preferred design as a programmable micro controller.

Preferably, the analysis arrangement 18 has an analysis switch 23, which compares the signals of the two measured value detectors 16, 17 with each other. The analysis switch 23 recognizes and evaluates, for example, voltage differences.

It may also be preferred that the analysis switch 23 divides the signals of the measured value detector 16, 17 into frequency components, like through a transformation preferred through a fast Fourier transformation, and determines a distortion factor in order to recognize and quantify distortions.

Based on the distortions, a leaving of the linear, unsaturated range of the magnetization of core 11 can be ruled out.

The output of the analysis switch 23 is preferably connected with the input of a controls witch 24. The control switch 24 is designed to compare the output value from the analysis switch 23 with a defined value and to correspondingly emit a signal to an output of the control switch 24. The defined value depends, for example, on the magnetic properties of the core 11.

Furthermore, it may be preferred that the switch arrangement 14 has a generator 19, in particular a generator switch, to create an electrical compensating current of definable voltage, frequency and phase, and that the generator 19 is at least connected with the third coil 15.

Through this, the magnetization in core 11 can be influenced and an initiating state of saturation worked against.

In accordance with the particularly preferred design, the generator 19 is connected with the output of the control switch 24.

Furthermore, the generator can be connected with the power supply, through which the generator 19 has the same phase as the current of the power supply.

The compensating current created by the generator 19 may, for example, have an evanescent sine wave form. Such a compensating current may be created simply from many standard components or in a high quality with a low distortion factor.

The compensating current generated by the generator 19 may, for example, have the network frequency.

Furthermore, the compensating current created by the generator 19 may have a slowly evanescent impulse.

It may be preferred that the compensating current has a higher frequency deviating from an electrical network to be protected. The frequency may be a whole number multiple of the network frequency. Through this, a threatening saturation of the core 11 may be reacted to quickly and faster than the response time of the residual current protection switch.

In accordance with the preferred design, it may be designated that an amplifier 20 is arranged between the generator 19 and the third coil 15. Through this, the generator 19 may be formed with high signal quality by low performance and low production efforts. Furthermore, an evanescent signal may be generated easily through a modifiable amplification factor.

Even without an exterior magnetic field strength, there is residual magnetization by magnetic materials, the so-called magnetic remanence. With the present application, therefore, in the worst case core 11 may be magnetized outside of the unsaturated range already before the flowing of a current in the two controllers 6, 8, through which the maintenance of an unsaturated state is made difficult upon closing the switch contact pairs 7, 9 or can no longer be guaranteed.

Preferred is therefore that the switch arrangement 14 is formed to cause an unsaturated state of the core 11. This may, for example, occur in that the generator 19 creates a falling and sine wave form current in the third coil 15, which leads to a de-magnetization of the core 11.

It may be preferred that the switch contact pairs 7, 9 are connected with the control switch 24, whereby upon activation of one of the operating elements 25 connected with the control switch 24, the core is first de-magnetized before the switch contact pairs 7, 9 are closed. Furthermore, after the separation of the two switch contact pairs 7, 9, a de-magnetization of the core may be executed.

Through this, a de-magnetization of the core 11 can be reached before using the switching device 1, through which on the one hand the unsaturated state of core 11 can be maintained reliably and on the other hand, the use of compensating currents may be reduced while using the switching device 1.

Additionally, it may be that before the switch contact pairs 7, 9 are closed, a functional inspection of the switching device 1 is executed by the control switch 24, whereby the switch contact pairs 7, 9 will not be closed if there is a negative result of the functional inspection. Through this, a reliable functioning of the switching device 1 and a disruption-free examination of the functionality of the residual current protection switch 21 may be guaranteed.

Furthermore, it is preferred to have a residual current protection switch 21, which contains a switching device 1 in accordance with the description above. Through this, a residual current protection switch 21 can be used with the benefits of the switching device 1 in switching cabinets without additional space being needed for switching device 1.

Furthermore, the patent includes a procedure to maintain an unsaturated state of a core 11 of a transformer 10, whereby a first voltage between a first controller 6 and a second controller 8 is measured before the core 11, whereby a second voltage between the first controller 6 and the second controller 8 is measured after the core 11, whereby a compensating current is determined from the difference of the first and second voltage, whereby another third coil 15 arranged on the core 11 is charged with a corrective voltage replicating the compensating current. The previously described advantages can be obtained through this.

Furthermore it may be preferred that before and/or after the flowing of a current in both controllers 6, 8, the core 11 of the transformer 10 is de-magnetized. Through this, on the one hand, the unsaturated state of the core 11 may be reliably maintained and on the other hand, the use of compensating currents may be reduced during the flowing of a current in both controllers 6, 8.

In the following, a particularly preferred procedure is described.

The operating element 25 is activated to bridge over the residual current protection switch 21. After this, the core 11 is de-magnetized through the switch arrangement 14. Then the two switch contact pairs 7, 9 are closed, through which the residual current protection switch 21 is bridged over. The current, which flows through the two controllers 6, 8, is made symmetrical through the transformer 10. If the core 11 of the transformer 10 is in an unsaturated state is determined through the comparison of the voltages between the first controller 6 and second controller 8 before and after the transformer. A distortion factor is determined in order to quantify the distortion created by the transformer 10. This distortion factor is compared with a defined value. If this defined value is exceeded, a falling, sine wave shaped and same phase as the grid compensating current will be generated in a third coil 15, whose frequency is a multiple of the grid frequency. The imminent saturation of the core 11 is countered through the compensating current in the third coil 15. After an examination of the functionality of the residual current protection switch 21, the operating element 25 will be activated a second time. After this, the switch contact pairs 7, 9 are separated again, which causes the residual current protection switch 21 to no longer be bridged over. After this, the core 11 is de-magnetized again.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A switching device for bridging over a residual current protection switch, the switching device comprising:

at least a first input and a second input;

at least a first output and a second output, wherein the first input is connected with the first output through a first controller and a first switch contact pair, and wherein the second input is connected with the second output through a second controller and a second switch contact pair;

a transformer with a core, the first controller forming at least a first coil of the transformer and the second controller forming at least a second coil of the transformer; and a switch arrangement configured to maintain an unsaturated state of the core, wherein the switch arrangement has a measured value detector configured to detect an initial voltage between the first controller and the second controller at a position before the transformer.

2. The switching device according to claim 1, wherein the switch arrangement is configured to provide a defined energy in the core.

3. The switching device according to claim 1, wherein the switch arrangement has a third coil disposed on the core.

4. The switching device according to claim 3, wherein the switch arrangement includes a generator switch configured to create an electrical compensating current with defined voltage, frequency and phase, and wherein the generator switch is connected directly with the third coil.

5. The switching device according to claim 4, wherein the compensating current has a higher frequency deviating from an electrical network to be protected.

6. The switching device according to claim 4, further comprising an amplifier disposed between the generator switch and the third coil.

7. The switching device according to claim 1, wherein the switch arrangement is configured as a control circuit.

8. The switching device according to claim 1, wherein the switch arrangement has a second measured value detector configured to detect a second voltage between the first controller and the second controller at a position after the transformer.

9. The switching device according to claim 8, wherein the switch arrangement has an analysis arrangement configured to analyze at least one of the first voltage, the second voltage and the second measured value detector in regards to distortions caused by the transformer.

10. The switching device according to claim 1, wherein the switch arrangement is configured to cause the unsaturated state of the core.

11. The switching device according to claim 1, wherein the transformer has a translation ratio of 1:1.

12. A residual current protection switch comprising a switching device according to claim 1.

13. A procedure for maintaining an unsaturated state of a core of a transformer, comprising:

measuring a first voltage between a first controller and a second controller before the core, the first controller forming at least a first winding of the transformer and the second controller forming at least a second winding of the transformer;

measuring a second voltage between the first controller and the second controller after the core;

determining a compensating current from a difference of the first voltage and the second voltage; and charging a third coil disposed on the core with a corrective voltage replicating the compensating current.

14. A switching device for bridging over a residual current protection switch, the switching device comprising:

at least a first input and a second input;

at least a first output and a second output, wherein the first input is connected with the first output through a first controller and a first switch contact pair, and wherein the second input is connected with the second output through a second controller and a second switch contact pair;

a transformer with a core, the first controller forming at least a first coil of the transformer and the second controller forming at least a second coil of the transformer; and a switch arrangement configured to maintain an unsaturated state of the core, the switch arrangement having a third coil disposed on the core and a generator switch connected directly with the third coil and configured to create an electrical compensating current with defined voltage, frequency and phase.

* * * * *